US006551176B1

(12) United States Patent
Garretson

(10) Patent No.: US 6,551,176 B1
(45) Date of Patent: Apr. 22, 2003

(54) PAD CONDITIONING DISK

(75) Inventor: Charles C. Garretson, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/684,141

(22) Filed: Oct. 5, 2000

(51) Int. Cl.[7] ..... B24B 1/00
(52) U.S. Cl. ..... 451/56; 451/443; 51/293
(58) Field of Search ..... 451/41, 56, 443; 51/293, 309; 428/209, 210

(56) References Cited

U.S. PATENT DOCUMENTS

| | | | | |
|---|---|---|---|---|
| 4,992,082 | A | | 2/1991 | Drawl et al. |
| 5,011,513 | A | | 4/1991 | Zador et al. |
| 5,216,843 | A | | 6/1993 | Breivogel et al. |
| 5,273,558 | A | | 12/1993 | Nelson et al. |
| 5,380,390 | A | | 1/1995 | Tselesin |
| 5,547,417 | A | | 8/1996 | Breivogel et al. |
| 5,595,527 | A | | 1/1997 | Appel et al. |
| 5,620,489 | A | | 4/1997 | Tselesin |
| 5,626,509 | A | | 5/1997 | Hayashi |
| 5,643,067 | A | | 7/1997 | Katsuoka et al. |
| 5,683,289 | A | | 11/1997 | Hempel, Jr. |
| 5,690,705 | A | | 11/1997 | Holmes et al. |
| 5,769,697 | A | | 6/1998 | Nishio |
| 5,779,521 | A | | 7/1998 | Muroyama et al. |
| 5,782,675 | A | | 7/1998 | Southwick |
| 5,785,585 | A | * | 7/1998 | Manfredi et al. ..... 451/56 X |
| 5,851,138 | A | | 12/1998 | Hempel, Jr. |
| 5,895,270 | A | | 4/1999 | Hempel, Jr. |
| 6,106,382 | A | * | 8/2000 | Sakaguchi ..... 451/56 X |
| 6,159,087 | A | | 12/2000 | Birang et al. |
| 6,190,240 | B1 | * | 2/2001 | Kinoshita et al. ..... 451/56 |
| 6,347,982 | B1 | | 2/2002 | Holzapfel |

FOREIGN PATENT DOCUMENTS

| | | |
|---|---|---|
| WO | 94/04599 | 3/1994 |
| WO | 97/40525 | 10/1997 |
| WO | 99/02309 | 1/1999 |

OTHER PUBLICATIONS

U.S. patent application Ser. No. 09/666,510, filed Sep. 20, 2000 (Birang et al.).

* cited by examiner

*Primary Examiner*—Joseph J. Hail, III
*Assistant Examiner*—Anthony Ojini
(74) *Attorney, Agent, or Firm*—Dugan & Dugan

(57) ABSTRACT

An end effector is provided for conditioning a polishing pad. The end effector comprises a backing plate, a matrix material adhered to a first surface of the backing plate, and a plurality of crystals embedded in the matrix material an amount sufficient to prevent the plurality of crystals from becoming dislodged from the matrix material during pad conditioning. The plurality of crystals have an absolute crystal height distribution that is skewed toward zero. Methods are also provided for forming the above-described end effector.

23 Claims, 3 Drawing Sheets

PAD CONDITIONING DISK

FIELD OF THE INVENTION

The present invention relates to the field of polishing pad conditioners, and more particularly to an improved end effector for conditioning pads used to polish the surface of semiconductor wafers or semiconductor devices, glass substrates and the like.

BACKGROUND

In the semiconductor industry, a semiconductor wafer is planarized or "polished" using a chemical mechanical polishing apparatus that presses a surface of the wafer against a surface of an abrasive pad and that moves the surface of the wafer relative to the surface of the abrasive pad. As polishing continues, the surface of the abrasive pad may become compacted and lose its abrasive quality. Such compaction reduces the quality and efficiency of the polishing process. Accordingly, the abrasive pad is conditioned or roughened (in situ or ex situ) via a device known as a pad conditioning end effector. Typically the end effector comprises one or more diamond crystals held by mechanical means (e.g., by screw type holding mechanisms). During pad conditioning the diamond crystals are pressed against the surface of the polishing pad and are moved relative to the surface of the polishing pad. When crystals are held via mechanical means, the crystals are necessarily relatively large and provide less than optimal pad conditioning. Accordingly, an improved pad conditioning end effector is needed.

SUMMARY OF THE INVENTION

To overcome the drawbacks of the prior art, an inventive end effector is provided for conditioning a polishing pad. The end effector comprises a backing plate, a matrix material adhered to a first surface of the backing plate, and a plurality of crystals embedded in the matrix material an amount sufficient to prevent the plurality of crystals from becoming dislodged from the matrix material during pad conditioning. The plurality of crystals have an absolute crystal height distribution that may be skewed toward zero. Methods are also provided for forming the inventive end effector.

Other features and aspects of the present invention will become more fully apparent from the following detailed description of the preferred embodiments, the appended claims and the accompanying drawings.

BRIEF DESCRIPTION

DETAILED DESCRIPTION

Figure 1A:
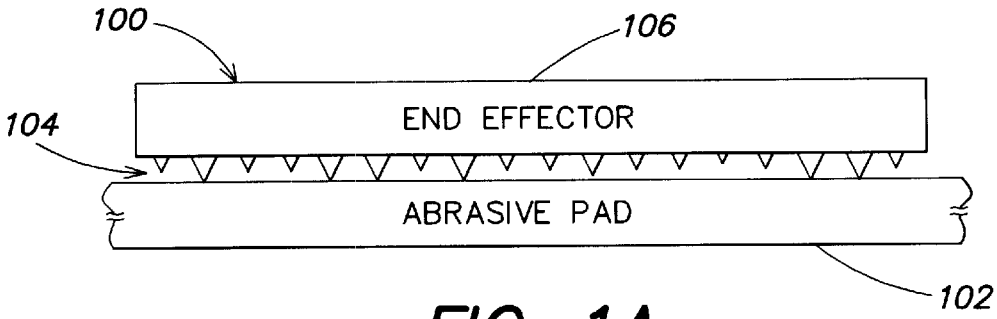
FIG. 1A (PRIOR ART)
FIG. 1A is a side view of a conventional end effector in contact with an abrasive pad.
Figure 1B:
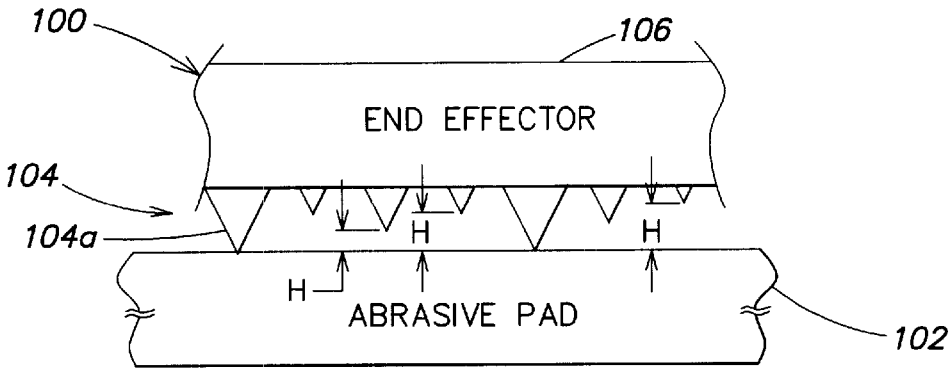
FIG. 1B (PRIOR ART)
FIG. 1B illustrates a close-up view of the conventional end effector of FIG. 1A.

FIG. 1A is a side view of a conventional end effector 100 in contact with an abrasive pad 102. As shown in FIG. 1A, the conventional end effector 100 includes a plurality of diamond crystals 104 that extend from a backing plate 106 of the end effector 100 toward the abrasive pad 102. FIG. 1B illustrates a close-up view of the conventional end effector 100 of FIG. 1A.

With reference to FIG. 1B, each of the diamond crystals 104 of the conventional end effector 100 may extend from the backing plate 106 by a different amount, and some of the crystals do not contact the abrasive pad 102. Accordingly, these "non-contacting" crystals cannot roughen the surface of the abrasive pad 102 during pad conditioning.

Figure 1C:
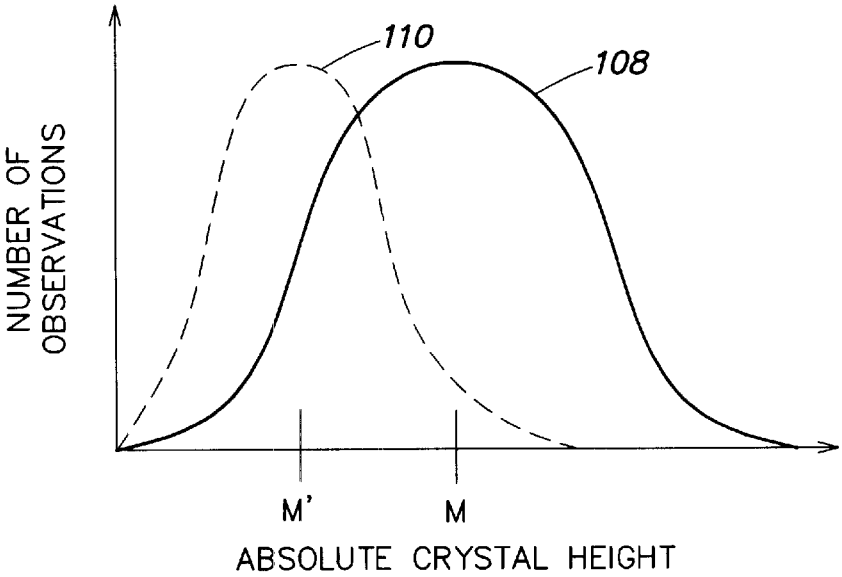
FIG. 1C illustrates an exemplary distribution of absolute crystal heights for the conventional end effector of FIGS. 1A and 1B.

The height (H) of a diamond crystal above the abrasive pad 102 when the end effector 100 is placed in contact with the abrasive pad 102 (as shown in FIGS. 1A and 1B) is termed the "absolute crystal height" of the crystal. Note that a crystal that contacts the abrasive pad 102 (such as crystal 104*a* in FIG. 1B) has an absolute crystal height of zero. FIG. 1C illustrates an exemplary distribution 108 of absolute crystal heights (absolute crystal height distribution 108) for the conventional end effector 100 of FIGS. 1A and 1B. The "mean" absolute crystal height is shown as M in FIG. 1C.

Ideally, for maximum conditioning efficiency and conditioning uniformity, the mean absolute crystal height of an end effector is zero (e.g., all crystals of the end effector contact the abrasive pad 102). However, any technique that can "skew" the absolute crystal height distribution of an end effector toward zero (e.g., as shown by the exemplary absolute crystal height distribution 110 of FIG. 1C which has a mean absolute crystal height of M') is advantageous as the resulting end effector may uniformly and efficiently condition a polishing pad (e.g., as more crystals will contact the abrasive pad during pad conditioning).

Figure 2A:
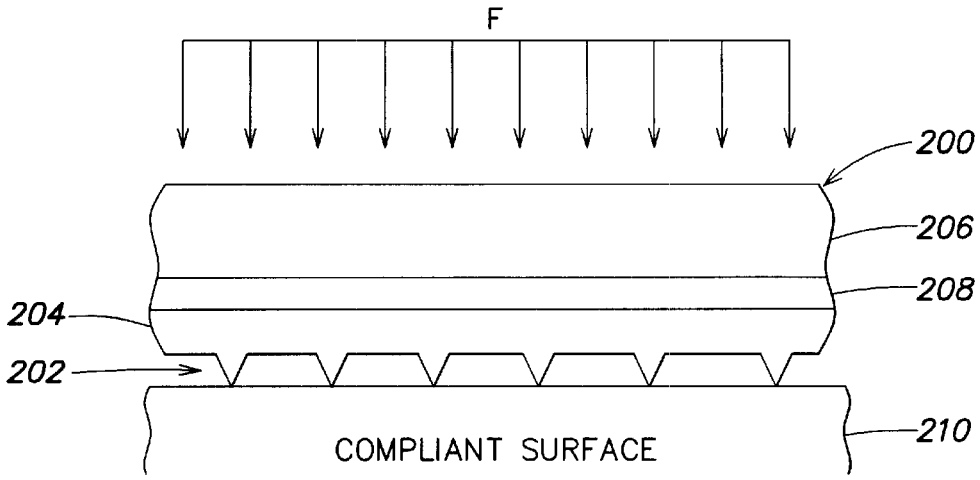
FIG. 2A illustrates a side view of a first embodiment of an inventive end effector shown in contact with a compliant surface.

In a first aspect of the invention and as shown in FIG. 2A, an inventive end effector 200 has a plurality of crystals 202 (e.g., diamonds) embedded in a matrix material (e.g., a metal substrate 204 such as a nickel alloy matrix material as is known in the art) an amount sufficient to prevent the plurality of crystals from becoming dislodged from the matrix material during pad conditioning. The matrix material may comprise any suitable matrix material, the crystals may be, for example, 9 mil. in height and the crystals may extend, for example, about 2.5 to 3.5 mils from the matrix material with a standard deviation of about 0.75 mil. The height each crystal extends from the matrix material is termed the exposure height of the crystal.

The end effector 200 also has an absolute crystal height distribution skewed toward zero. For example, in at least one embodiment of the invention, an absolute crystal height distribution of the end effector 200 may be skewed toward zero by: (1) obtaining the metal alloy substrate 204 having the crystals 202 extending therefrom with a first absolute crystal height distribution (e.g., the absolute crystal height distribution 108 of FIG. 1C); (2) bonding the metal alloy substrate 204 to a metal backing plate 206 using a bonding material 208; (3) contacting the exposed crystal surface of the metal alloy substrate 204 to a surface of a slightly compliant material (e.g., a surface 210 such as polyurethane that will allow the crystals 202 to penetrate the surface 210 to a distance just below the surface 210 (e.g., about 1–2 mils)); and (4) applying a large force to the back of the metal backing plate 206 so as to force the crystal surface against the slightly compliant material while the bonding material 208 cures. Because the metal alloy substrate 204 will deflect slightly at locations wherein a crystal does not touch the compliant surface 210 (e.g., at locations of the polishing pad having a large absolute crystal height), the absolute crystal height distribution of the end effector 200 will be skewed toward zero as shown by the absolute crystal height distribution 110 of FIG. 1C (relative to a normal "bell curve" distribution 108) as crystals that do not contact the surface 210 will move toward the surface 210 (e.g., crystal 202*a* in FIG. 2B). For one exemplary inventive end effector 200, the metal alloy substrate 204 comprises a nickel alloy having a thickness of about 0.032 inches with diamond crystals 202 spaced by about 0.1 inches as shown in FIG. 2B.

In one embodiment of the invention, the mean absolute crystal height distribution of the diamond crystals 202 before curing may be about 1.5 mils, the average diamond crystal size may be about 9 mils and the average exposure height of each diamond crystal may be about 3 to 3.5 mils with a standard deviation of about 0.75 mil or less. The metal backing plate 206 may be a stainless steel backing plate having a thickness of about 0.2 inches and the bonding material 208 comprises a conventional bonding material (as is known in the art) having a thickness of about 0.5 to 2 mils. The bonding material 208 may be cured, for example, by heating the bonding material 208 (e.g., to a curing temperature set by the manufacturer of the bonding material 208) while a force of about 1000 pounds per square inch may be applied to the backing plate 206. Following curing under the application of the 1000 pounds per square inch force, the mean absolute crystal height distribution of the diamond crystals 202 may be about 0.75 mils. Deviations resulting from deflection of the metal substrate 204 will be filled by the bonding material 208.

More specific details for adhering diamonds to a metal substrate are disclosed in U.S. Pat. No. 5,380,390 titled "Patterned Abrasive Material and Method," the entire disclosure of which is incorporated herein by this reference. As described in further detail in U.S. Pat. No. 5,380,390, a substrate may be coated with an adhesive and then may be contacted with the abrasive particles (e.g., diamond crystals). The crystals which do not adhere are removed, and the adhered crystals may be oriented, for example, by shaking/vibrating the substrate such that the adhered crystals assume a stable position, and/or by applying a magnetic force such that the crystals may be aligned according to their crystallographic structure and according to lines of magnetic force. Once oriented, the crystals may be sprayed with an adhesive, or sprayed with a liquid which may be subsequently frozen, so as to maintain the crystals' orientation. Thereafter, to permanently hold the crystals, the crystals may be contacted with a sinterable or fusible material (possibly in the form of a preform) and heat and/or pressure may be applied to complete the abrasive material. These methods may be employed in conjunction with the backing plate method described above.

Figure 2B:
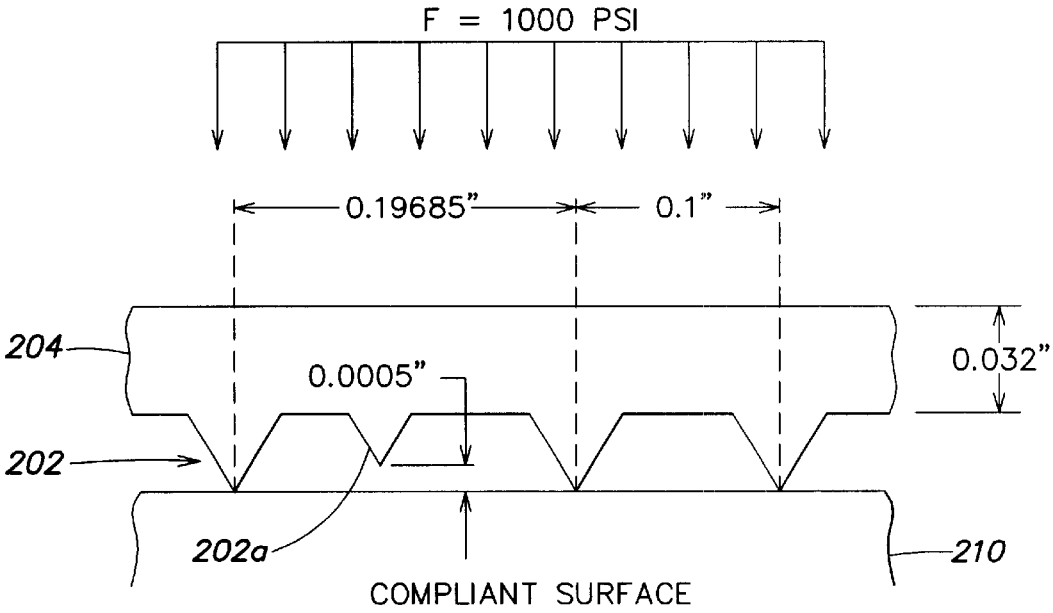
FIG. 2B illustrates a side view of a second embodiment of an inventive end effector shown in contact with a compliant surface.
Figure 3:
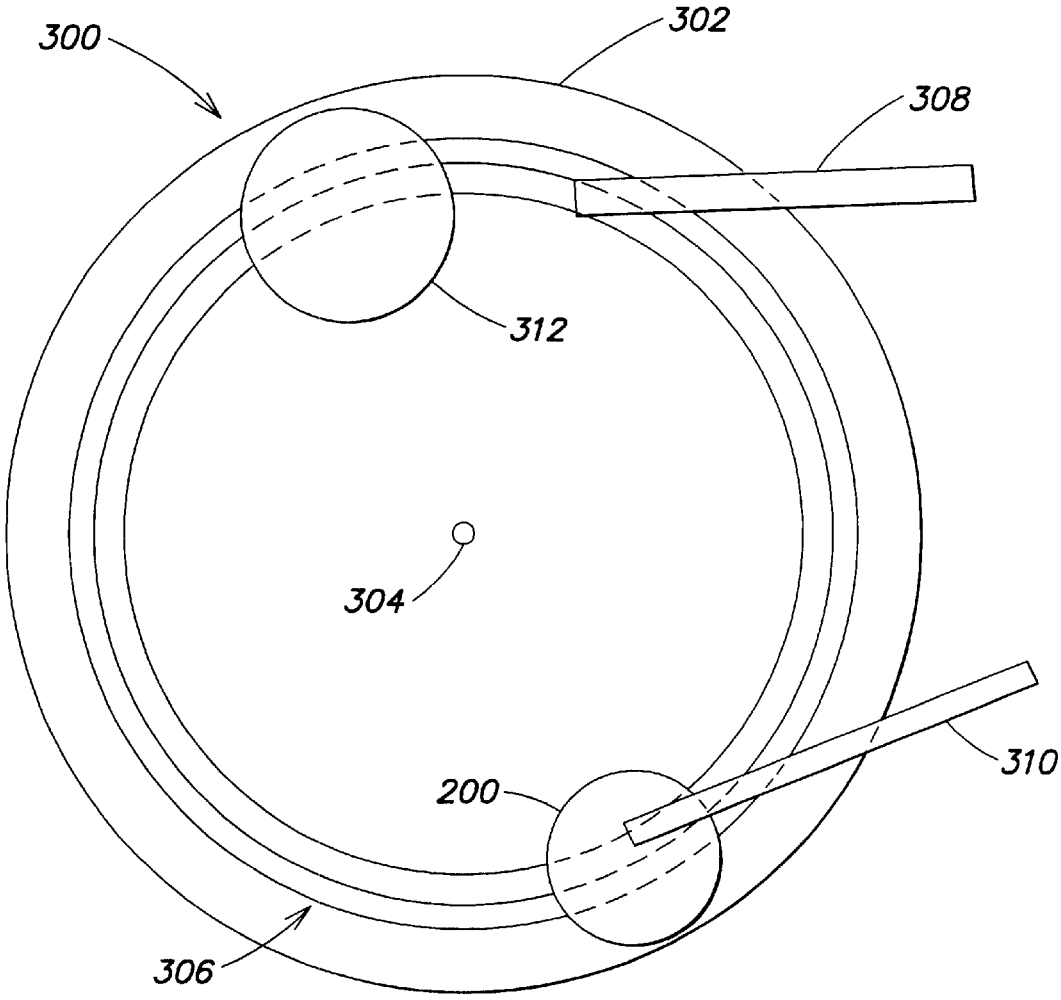
FIG. 3 shows a top plan view of a semiconductor device polishing apparatus which employs the inventive end effector of FIGS. 2A and 2B.

FIG. 3 shows a top plan view of a semiconductor device polishing apparatus 300 which employs the inventive end effector 200 of FIGS. 2A and 2B. The polishing apparatus 300 comprises a polishing pad 302 which rotates about a center point 304 at a given speed. The polishing pad 302 has a plurality of grooves 306 formed in the top surface of the polishing pad 302. These grooves aid the channeling of an abrasive slurry across the surface of the pad. The abrasive slurry (not shown) is supplied via an inlet 308. A conditioning arm 310 may be rotatably disposed along the side of the polishing pad 302. The inventive end effector 200 may be mounted to the conditioning arm 310 (e.g., via screws attached to the backing plate 206).

In operation, the polishing pad 302 may be conditioned during the polishing of the semiconductor device (i.e., in situ conditioning) or during a separate pad conditioning step (i.e., ex situ conditioning). During in situ conditioning, a wafer 312 may be mounted along one side of the end effector 200 and rotates in a first direction while being swept radially across the surface of the polishing pad 302. The polishing pad 302 rotates as the slurry (not shown) is supplied to the surface of the polishing pad via the inlet 308. Simultaneously therewith, the conditioning arm 310 sweeps the inventive end effector 200, which in one embodiment may rotate in the same direction the pad rotates, radially across the surface of the polishing pad 302 while applying a downward force. In one embodiment, the end effector 200 rotates at a rate of 20–120 r.p.m. and may be pressed against the polishing pad 302 with a downward force of 5–10 pounds given the area of the end effector and density of crystals. The inventive end effector 200, with its skewed absolute crystal height distribution, may provide a desired balance of polishing pad surface roughening, so that a consistent polish rate may be maintained, and of polishing pad life, so that material and downtime costs may be minimized. During conditioning of the polishing pad 302, crystals which extend farthest from the metal substrate 204, will wear as the crystals contact the polishing pad first. As these crystals wear, such that they no longer extend as far from the metal substrate 204, additional crystals will contact the polishing pad 302. The skew of the absolute crystal height distribution may ensure that the polishing pad 302 may be continuously contacted by "sharp" crystal surfaces.

The foregoing description discloses only the preferred embodiments of the invention, modifications of the above disclosed apparatus and method which fall within the scope of the invention will be readily apparent to those of ordinary skill in the art. For instance, although the polishing apparatus has been described as having a rotary arm for sweeping a rotating disc type end effector across the surface of the polishing pad, the inventive end effector may assume other shapes such as the stationary bar type conditioners disclosed in commonly assigned U.S. Pat. No. 6,036,583 (U.S. patent application Ser. No. 08/890,781), filed Jul. 11, 1997 and titled "Apparatus for Conditioning a Polishing Pad in a Chemical Mechanical Polishing System," the entirety of which is incorporated herein by this reference, and may be employed with other types of polishing apparatuses such as those employing translating conditioning bands, etc. Accordingly, as used herein, a mechanism for moving the end effector across the polishing pad is to be construed broadly to cover movement of the end effector and/or movement (e.g., rotary, linear, etc.) of the polishing pad.

The invention applies to any end effector having a plurality of crystals as described herein. Any known technique may be employed to adhere the substrate 204 to the backing plate 206 (e.g., such as via use of any conventional compliant bonding material), and other crystal exposure heights may be employed. In at least one embodiment of the invention, an average crystal exposure height of 1 mil. or greater may be employed. Other crystal spacings may be employed, and the force applied to the backing plate 206 may be varied (e.g., depending on the crystal spacing, the backing plate thickness, etc.).

Any rigid material (e.g., stainless steel) may be employed as the backing plate 206. The matrix material 204 alternatively may be a polymer. When used in connection with the polishing of oxide layers the polymer may be chemically inert so that it is not reactive with the polishing slurry. Further, should polymer particles become embedded on the surface of a silicon wafer being polished, the polymer particles (unlike particles of a metal matrix) will not act as a conductor. For an oxide polish the polymer's modulus may be substantially less than the modulus of oxide, fused silicon, or quartz. Further, the matrix 15 may be treated to resist corrosion. The term matrix, as used herein refers to any material in which diamonds may be embedded. The crystals may be approximately the same size or may vary in size. A known amount of crystals may be applied to the matrix, may be embedded a predetermined amount (e.g., 75 percent of the crystal's height) so as to substantially deter or prevent crystal dislodgment during normal polishing conditions, and may be approximately evenly spaced, as taught by U.S. patent application Ser. No. 09/241,910 titled "Improved End Effector for Pad Conditioning", filed on Feb. 2, 1999, the entire disclosure of which is incorporated herein by reference.

Any other method for producing a skewed absolute crystal height distribution may be similarly employed. In at least one embodiment, the average absolute crystal height distribution may be selected so as to introduce new cutting edges at a rate that produces approximately constant pad wear during pad conditioning and/or during polishing (e.g., a skewed absolute crystal height distribution may introduce new (and more) cutting edges faster than a "normal" absolute crystal height distribution as cutting edges round during pad conditioning and/or during chemical mechanical polishing). In at least one embodiment, the average absolute crystal height distribution may be selected so that the number of cutting edges that contact a pad during conditioning remains approximately constant for an approximately constant force applied to the end effector 200 (e.g., despite rounding of the crystals 202 during conditioning). Accordingly, while the present invention has been disclosed in connection with the preferred embodiments thereof, it should be understood that other embodiments may fall within the spirit and scope of the invention.

Accordingly, while the present invention has been disclosed in connection with the preferred embodiments thereof, it should be understood that other embodiments may fall within the spirit and scope of the invention, as defined by the following claims.

What is claimed is:

1. An apparatus comprising:

an end effector for conditioning a polishing pad, having:

a backing plate;

a matrix material adhered to a first surface of the backing plate; and a plurality of crystals embedded in the matrix material; wherein the plurality of crystals have an absolute crystal height distribution that is skewed toward zero relative to a normal absolute crystal height distribution.

2. The apparatus of claim 1 wherein the backing plate comprises stainless steel.

3. The apparatus of claim 2 wherein the backing plate has a thickness of about 0.2 inches.

4. The apparatus of claim 1 wherein the matrix material comprises a metal substrate.

5. The apparatus of claim 4 wherein the metal substrate comprises a nickel alloy.

6. The apparatus of claim 5 wherein the metal substrate has a thickness of about 0.032 inches.

7. The apparatus of claim 1 wherein the plurality of crystals are spaced by about 0.1 inches.

8. The apparatus of claim 1 wherein the plurality of crystals have an average exposure height of about 3 to 3.5 mils with a standard deviation of about 0.75 mil or less.

9. The apparatus of claim 1 wherein the matrix material is adhered to the backing plate with a bonding material.

10. The apparatus of claim 9 wherein the bonding material comprises a heat-curable bonding material.

11. The apparatus of claim 10 wherein the bonding material has a thickness of about 0.5 to 2 mils.

12. The apparatus of claim 1 wherein the plurality of crystals have a mean absolute crystal height distribution of about 0.75 mils.

13. The apparatus of claim 1, wherein the backing plate is adapted to be mounted to a polishing pad conditioning mechanism.

14. The apparatus of claim 13, wherein the backing plate is adapted to be mounted to a conditioning arm.

15. The apparatus of claim 1, wherein the matrix has been treated to resist corrosion.

16. An apparatus comprising:

an inlet for supplying a slurry to a polishing pad;

a conditioning arm disposed along the polishing pad; and an end effector coupled to the conditioning arm, the end effector for conditioning the polishing pad;

the end effector including:

a backing plate;

a matrix material adhered to a first surface of the backing plate; and a plurality of crystals embedded in the matrix material; wherein the plurality of crystals have an absolute crystal height distribution that is skewed toward zero relative to a normal absolute crystal height distribution.

17. The apparatus of claim 16, wherein the backing plate is adapted to be coupled to the conditioning arm.

18. A method of forming an end effector comprising:

obtaining a matrix material having a plurality of crystals extending from a first side of the matrix material, the plurality of crystals having a first absolute crystal height distribution;

bonding a second side of the matrix material to a backing plate using a bonding material;

contacting at least a portion of the plurality of crystals to a surface which faces the first side of the matrix material;

applying a force to the backing plate so as to press the at least a portion of the plurality of crystals against the surface which faces the first side of the matrix material; and allowing the bonding material to cure during the step of applying the force.

19. The method of claim 18 wherein the surface comprises polyurethane.

20. The method of claim 18 wherein the force comprises about 1000 pounds per square inch.

21. An end effector formed from the method of claim 18.

22. The method of claim 18, wherein the backing plate is adapted to be mounted to a polishing pad conditioning mechanism.

23. A method of conditioning a polishing pad comprising:

providing a polishing pad; and contacting the polishing pad with a conditioner comprising a plurality of crystals embedded in a matrix material such that the plurality of crystals have an absolute crystal height distribution that is skewed toward zero relative to a normal absolute crystal height distribution.

* * * * *